US010540985B2

(12) United States Patent
Norton et al.

(10) Patent No.: US 10,540,985 B2
(45) Date of Patent: Jan. 21, 2020

(54) IN-VEHICLE MEDIA VOCAL SUPPRESSION

(71) Applicant: FORD GLOBAL TECHNOLOGIES, LLC, Dearborn, MI (US)

(72) Inventors: Alan Norton, West Bloomfield, MI (US); James Buczkowski, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/884,708

(22) Filed: Jan. 31, 2018

(65) Prior Publication Data

US 2019/0237092 A1 Aug. 1, 2019

(51) Int. Cl.
*G10L 21/0272* (2013.01)
*G10L 21/034* (2013.01)

(52) U.S. Cl.
CPC ..... *G10L 21/0272* (2013.01); *G10L 21/034* (2013.01)

(58) Field of Classification Search
CPC ..... G10L 21/0272; G10L 21/034
See application file for complete search history.

(56) References Cited

U.S. PATENT DOCUMENTS 9,942,678 B1 * 4/2018 Hartung ..... H04R 29/007
2005/0228647 A1 * 10/2005 Fisher ..... G10L 25/78 704/205
2008/0113325 A1 5/2008 Mellqvist et al.
2010/0107856 A1 * 5/2010 Hetherington ..... G10H 1/366 84/610
2011/0004474 A1 * 1/2011 Bansal ..... H04H 60/45 704/246
2015/0358730 A1 * 12/2015 Kirsch ..... H04R 3/002 381/71.1
2016/0071525 A1 3/2016 Di Censo et al.
2016/0180861 A1 6/2016 Masuda
2018/0035205 A1 * 2/2018 Vautin ..... H03G 3/3005

* cited by examiner

*Primary Examiner* — Sonia L Gay
(74) *Attorney, Agent, or Firm* — Michael J. Spenner; Brooks Kushman P.C.

(57) ABSTRACT

An audio processor generates a vocal-free audio signal from an audio signal received from an audio source, directs a cross-fader to fade from the audio signal to the vocal-free audio signal responsive to occurrence of a trigger condition indicated by a status signal, and directs the cross-fader to fade from the vocal-free audio signal to the audio signal responsive to the trigger condition no longer being present.

20 Claims, 4 Drawing Sheets

IN-VEHICLE MEDIA VOCAL SUPPRESSION

TECHNICAL FIELD

Aspects of the disclosure generally relate to vocal suppression functionality applied to media audio in the vehicle environment to aid in improving user concentration.

BACKGROUND

Many modern vehicles are equipped with a hands-free communication system that uses a microphone or multiple microphones to receive an audio signal including occupant voices. This audio signal is fed to a voice recognition system for vehicle control or a hands-free telephony system, or is used for communication to other zones in the vehicle. The user experience with these technologies is that playing media such as radio, streamed audio, or other music sources is hard muted during "voice sessions" to enable the occupant to focus on the content of that voice session.

SUMMARY

In one or more illustrative examples, a system includes an audio processor programmed to generate an audio signal without vocals from an audio signal received from an audio source, direct a cross-fader to fade from the audio signal to the audio signal without vocals responsive to occurrence of a trigger condition indicated by a status signal, and direct the cross-fader to fade from the audio signal without vocals to the audio signal responsive to trigger condition no longer being present.

In one or more illustrative examples, a method includes directing a cross-fader to fade from a received audio signal to an audio signal without vocals responsive to occurrence of a trigger condition indicating a prompt is to be provided; providing the prompt summed to the audio signal without vocals; and directing the cross-fader to fade from the audio signal without vocals to the audio signal responsive to the prompt being provided.

In one or more illustrative examples, a non-transitory computer-readable medium comprising instructions that, when executed by an audio processor, cause the audio processor to generate an audio signal without vocals from an audio signal received from an audio source; direct a cross-fader to fade from the audio signal to the audio signal without vocals responsive to occurrence of a trigger condition indicated by a status signal; and direct the cross-fader to fade from the audio signal without vocals to the audio signal responsive to trigger condition no longer being present.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

The user experience when using voice-enabled technologies in a vehicle is that media such as radio, streamed audio, or other music sources is hard muted during "voice sessions" to enable the occupant to focus on the content of that voice session. The result is an uncomfortable and inconsistent audio level and content mix experienced during, for example, an incoming phone call scenario (e.g., music—mute—ring tone—answer/conversation—hang up call—music resumes).

The effects of background media in systems that require processing of human voice may be reduced by removal of vocals from the background media that is being played. For example, during system prompts (such as navigation commands) or during an active voice control session or telephone call, audio content continues to play at a background level with the vocal content suppressed. Further aspects of the disclosure are discussed in detail below.

Figure 1:
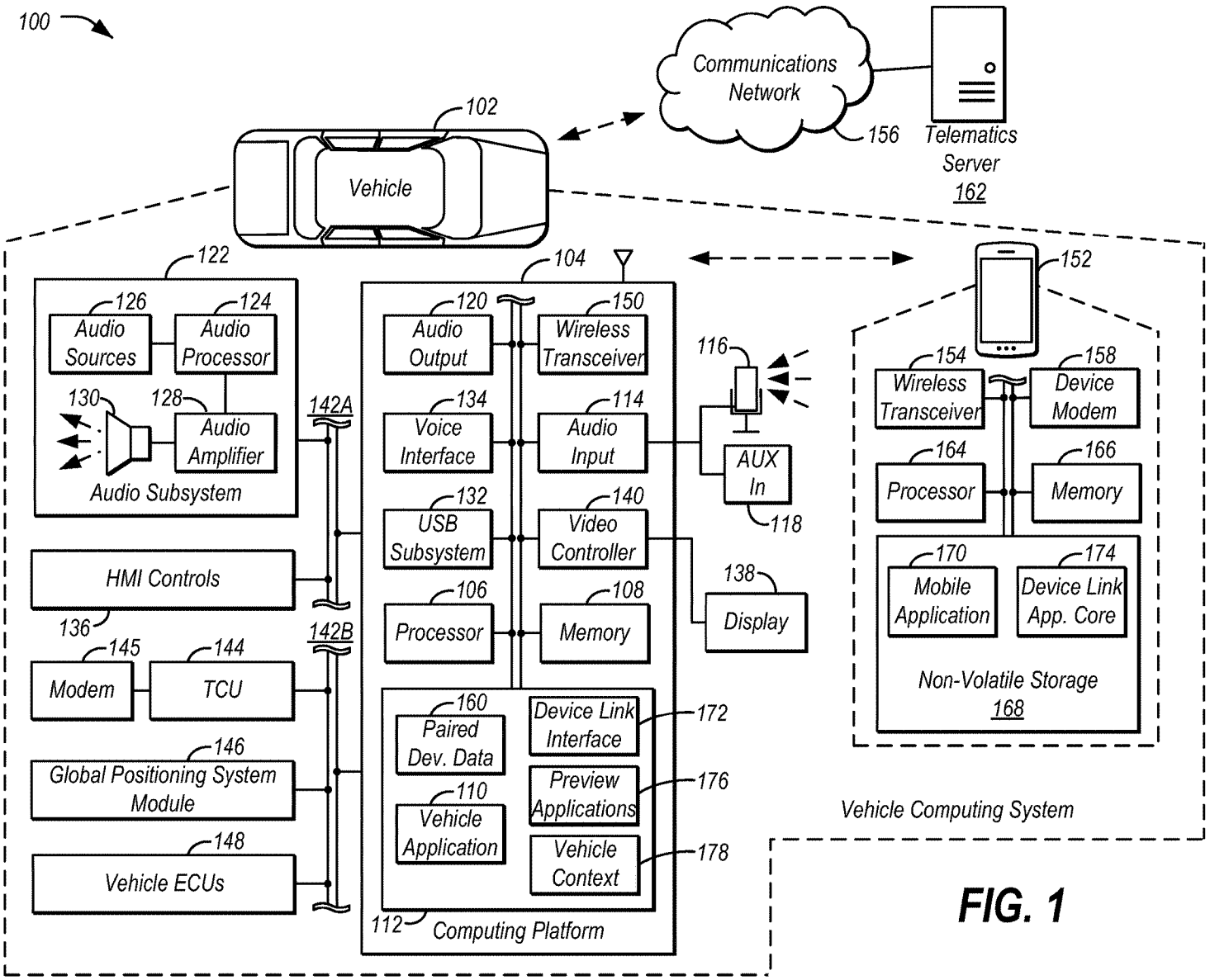
FIG. 1 illustrates an example diagram of a system configured to provide telematics services to a vehicle.

FIG. 1 illustrates an example diagram of a system 100 configured to provide telematics services to a vehicle 102. The vehicle 102 may include various types of passenger vehicle, such as crossover utility vehicle (CUV), sport utility vehicle (SUV), truck, recreational vehicle (RV), boat, plane or other mobile machine for transporting people or goods. Telematics services may include, as some non-limiting possibilities, navigation, turn-by-turn directions, vehicle health reports, local business search, accident reporting, and hands-free calling. In an example, the system 100 may include the SYNC system manufactured by The Ford Motor Company of Dearborn, Mich. It should be noted that the illustrated system 100 is merely an example, and more, fewer, and/or differently located elements may be used.

A computing platform 104 may include one or more processors 106 configured to perform instructions, commands, and other routines in support of the processes described herein. For instance, the computing platform 104 may be configured to execute instructions of vehicle applications 110 to provide features such as navigation, accident reporting, satellite radio decoding, and hands-free calling. Such instructions and other data may be maintained in a non-volatile manner using a variety of types of computer-readable storage medium 112. The computer-readable medium 112 (also referred to as a processor-readable medium or storage) includes any non-transitory medium (e.g., a tangible medium) that participates in providing instructions or other data that may be read by the processor 106 of the computing platform 104. Computer-executable instructions may be compiled or interpreted from computer programs created using a variety of programming languages and/or technologies, including, without limitation, and either alone or in combination, Java, C, C++, C#, Objective C, Fortran, Pascal, Java Script, Python, Perl, and PL/SQL.

The computing platform 104 may be provided with various features allowing the vehicle occupants to interface with the computing platform 104. For example, the computing platform 104 may include an audio input 114 configured to receive spoken commands from vehicle occupants through a connected microphone 116, and an auxiliary audio input 118 configured to receive audio signals from connected devices.

The auxiliary audio input 118 may be a physical connection, such as an electrical wire or a fiber optic cable, or a wireless input, such as a BLUETOOTH audio connection or Wi-Fi connection. In some examples, the audio input 114 may be configured to provide audio processing capabilities, such as pre-amplification of low-level signals, and conversion of analog inputs into digital data for processing by the processor 106.

The computing platform 104 may also provide one or more audio outputs 120 to an input of an audio module 122 having audio playback functionality. In other examples, the computing platform 104 may provide platform audio from the audio output 120 to an occupant through use of one or more dedicated speakers (not illustrated). The audio output 120 may include, as some examples, system generated chimes, pre-recorded chimes, navigation prompts, other system prompts, or warning signals.

The audio module 122 may include an audio processor 124 configured to perform various operations on audio content received from a selected audio source 126 and to platform audio received from the audio output 120 of the computing platform 104. The audio processors 124 may be one or more computing devices capable of processing audio and/or video signals, such as a computer processor, microprocessor, a digital signal processor, or any other device, series of devices or other mechanisms capable of performing logical operations. The audio processor 124 may operate in association with a memory to execute instructions stored in the memory. The instructions may be in the form of software, firmware, computer code, or some combination thereof, and when executed by the audio processors 124 may provide audio recognition and audio generation functionality. The instructions may further provide for audio cleanup (e.g., noise reduction, filtering, etc.) prior to the processing of the received audio. The memory may be any form of one or more data storage devices, such as volatile memory, non-volatile memory, electronic memory, magnetic memory, optical memory, or any other form of data storage device.

The audio subsystem may further include an audio amplifier 128 configured to receive a processed signal from the audio processor 124. The audio amplifier 128 may be any circuit or standalone device that receives audio input signals of relatively small magnitude, and outputs similar audio signals of relatively larger magnitude. The audio amplifier 128 may be configured to provide for playback through vehicle speakers 130 or headphones (not illustrated).

The audio sources 126 may include, as some examples, decoded amplitude modulated (AM) or frequency modulated (FM) radio signals, and audio signals from compact disc (CD) or digital versatile disk (DVD) audio playback. The audio sources 126 may also include audio received from the computing platform 104, such as audio content generated by the computing platform 104, audio content decoded from flash memory drives connected to a universal serial bus (USB) subsystem 132 of the computing platform 104, and audio content passed through the computing platform 104 from the auxiliary audio input 118. For instance, the audio sources 126 may also include Wi-Fi streamed audio, USB streamed audio, Bluetooth streamed audio, internet streamed audio, TV audio, as some other examples.

The computing platform 104 may utilize a voice interface 134 to provide a hands-free interface to the computing platform 104. The voice interface 134 may support speech recognition from audio received via the microphone 116 according to a standard grammar describing available command functions, and voice prompt generation for output via the audio module 122. The voice interface 134 may utilize probabilistic voice recognition techniques using the standard grammar in comparison to the input speech. In many cases, the voice interface 134 may include a standard user profile tuning for use by the voice recognition functions to allow the voice recognition to be tuned to provide good results on average, resulting in positive experiences for the maximum number of initial users. In some cases, the system may be configured to temporarily mute or otherwise override the audio source specified by an input selector when an audio prompt is ready for presentation by the computing platform 104 and another audio source 126 is selected for playback.

The microphone 116 may also be used by the computing platform 104 to detect the presence of in-cabin conversations between vehicle occupants. In an example, the computing platform may perform speech activity detection by filtering audio samples received from the microphone 116 to a frequency range in which first formants of speech are typically located (e.g., between 240 and 2400 HZ), and then applying the results to a classification algorithm configured to classify the samples as either speech or non-speech. The classification algorithm may utilize various types of artificial intelligence algorithm, such as pattern matching classifiers, K nearest neighbor classifiers, as some examples.

The computing platform 104 may also receive input from human-machine interface (HMI) controls 136 configured to provide for occupant interaction with the vehicle 102. For instance, the computing platform 104 may interface with one or more buttons or other HMI controls configured to invoke functions on the computing platform 104 (e.g., steering wheel audio buttons, a push-to-talk button, instrument panel controls, etc.). The computing platform 104 may also drive or otherwise communicate with one or more displays 138 configured to provide visual output to vehicle occupants by way of a video controller 140. In some cases, the display 138 may be a touch screen further configured to receive user touch input via the video controller 140, while in other cases the display 138 may be a display only, without touch input capabilities.

The computing platform 104 may be further configured to communicate with other components of the vehicle 102 via one or more in-vehicle networks 142. The in-vehicle networks 142 may include one or more of a vehicle controller area network (CAN), an Ethernet network, and a media oriented system transfer (MOST), as some examples. The in-vehicle networks 142 may allow the computing platform 104 to communicate with other vehicle 102 systems, such as a telematics control unit 144 having an embedded modem, a global positioning system (GPS) module 146 configured to provide current vehicle 102 location and heading information, and various vehicle electronic control units (ECUs) 148 configured to cooperate with the computing platform 104. As some non-limiting possibilities, the vehicle ECUs 148 may include a powertrain control module configured to provide control of engine operating components (e.g., idle control components, fuel delivery components, emissions control components, etc.) and monitoring of engine operating components (e.g., status of engine diagnostic codes); a body control module configured to manage various power control functions such as exterior lighting, interior lighting, keyless entry, remote start, and point of access status verification (e.g., closure status of the hood, doors, and/or trunk of the vehicle 102); a radio transceiver module configured to communicate with key fobs or other local vehicle 102 devices; and a climate control management module configured to provide control and monitoring of heating and cooling system components (e.g., compressor clutch and blower fan control, temperature sensor information, etc.).

As shown, the audio module 122 and the HMI controls 136 may communicate with the computing platform 104 over a first in-vehicle network 142-A, and the telematics control unit 144, GPS module 146, and vehicle ECUs 148 may communicate with the computing platform 104 over a second in-vehicle network 142-B. In other examples, the computing platform 104 may be connected to more or fewer in-vehicle networks 142. Additionally or alternately, one or more HMI controls 136 or other components may be connected to the computing platform 104 via different in-vehicle networks 142 than shown, or directly without connection to an in-vehicle network 142.

The computing platform 104 may also be configured to communicate with mobile devices 152 of the vehicle occupants. The mobile devices 152 may be any of various types of portable computing device, such as cellular phones, tablet computers, smart watches, laptop computers, portable music players, or other devices capable of communication with the computing platform 104. In many examples, the computing platform 104 may include a wireless transceiver 150 (e.g., a BLUETOOTH module, a ZIGBEE transceiver, a Wi-Fi transceiver, an IrDA transceiver, an RFID transceiver, etc.) configured to communicate with a compatible wireless transceiver 154 of the mobile device 152. Additionally or alternately, the computing platform 104 may communicate with the mobile device 152 over a wired connection, such as via a USB connection between the mobile device 152 and the USB subsystem 132. In some examples, the mobile device 152 may be battery powered, while in other cases the mobile device 152 may receive at least a portion of its power from the vehicle 102 via the wired connection.

A communications network 156 may provide communications services, such as packet-switched network services (e.g., Internet access, VoIP communication services), to devices connected to the communications network 156. An example of a communications network 156 may include a cellular telephone network. Mobile devices 152 may provide network connectivity to the communications network 156 via a device modem 158 of the mobile device 152. To facilitate the communications over the communications network 156, mobile devices 152 may be associated with unique device identifiers (e.g., mobile device numbers (MDNs), Internet protocol (IP) addresses, etc.) to identify the communications of the mobile devices 152 over the communications network 156. In some cases, occupants of the vehicle 102 or devices having permission to connect to the computing platform 104 may be identified by the computing platform 104 according to paired device data 160 maintained in the storage medium 112. The paired device data 160 may indicate, for example, the unique device identifiers of mobile devices 152 previously paired with the computing platform 104 of the vehicle 102, such that the computing platform 104 may automatically reconnected to the mobile devices 152 referenced in the paired device data 160 without user intervention.

When a mobile device 152 that supports network connectivity is paired with and connected to the computing platform 104, the mobile device 152 may allow the computing platform 104 to use the network connectivity of the device modem 158 to communicate over the communications network 156 with a remote telematics server 162 or other remote computing device. In one example, the computing platform 104 may utilize a data-over-voice plan or data plan of the mobile device 152 to communicate information between the computing platform 104 and the communications network 156. Additionally or alternately, the computing platform 104 may utilize the telematics control unit 144 to communicate information between the computing platform 104 and the communications network 156, without use of the communications facilities of the mobile device 152.

Similar to the computing platform 104, the mobile device 152 may include one or more processors 164 configured to execute instructions of mobile applications 170 loaded to a memory 166 of the mobile device 152 from storage medium 168 of the mobile device 152. In some examples, the mobile applications 170 may be configured to communicate with the computing platform 104 via the wireless transceiver 154 and with the remote telematics server 162 or other network services via the device modem 158.

For instance, the computing platform 104 may include a device link interface 172 to facilitate the integration of functionality of the mobile applications 170 configured to communicate with a device link application core 174 executed by the mobile device 152. In some examples, the mobile applications 170 that support communication with the device link interface 172 may statically link to or otherwise incorporate the functionality of the device link application core 174 into the binary of the mobile application 170. In other examples, the mobile applications 170 that support communication with the device link interface 172 may access an application programming interface (API) of a shared or separate device link application core 174 to facilitate communication with the device link interface 172.

The integration of functionality provided by the device link interface 172 may include, as an example, the ability of mobile applications 170 executed by the mobile device 152 to incorporate additional voice commands into the grammar of commands available via the voice interface 134. The device link interface 172 may also provide the mobile applications 170 with access to vehicle information available to the computing platform 104 via the in-vehicle networks 142. The device link interface 172 may further provide the mobile applications 170 with access to the vehicle display 138. An example of a device link interface 172 may be the SYNC APPLINK component of the SYNC system provided by the Ford Motor Company of Dearborn, Mich. Other examples of device link interfaces 172 may include MIRRORLINK, APPLE CARPLAY, and ANDROID AUTO.

Figure 2:
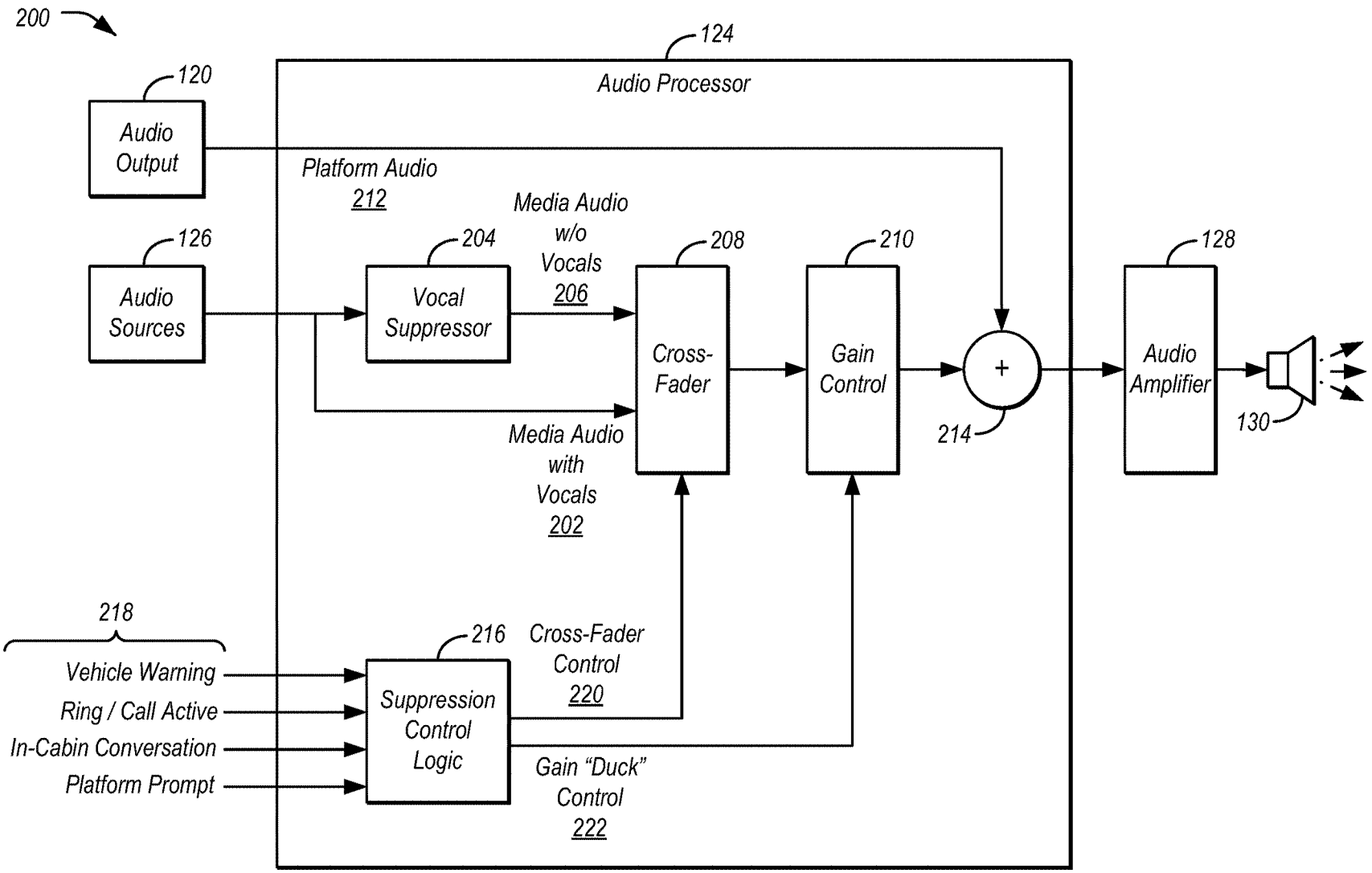
FIG. 2 illustrates an example block diagram of logic and signal control for performance of vocal suppression.

FIG. 2 illustrates an example block diagram 200 of logic and signal control for performance of vocal suppression. As shown, a media audio signal with vocals 202 is received by the audio processor 124 from the audio sources 126. A vocal suppressor 204 transforms the media audio signal with vocals 202 into a media audio signal without vocals 206. The media audio signal with vocals 202 and the media audio signal without vocals 206 are each provided to a cross-fader 208, which feeds a combined signal into a gain control 210. A platform audio signal 212 from the audio output 120 of the computing platform 104 is also received by the audio processor 124. An adder 214 receives the audio output 120 and the output from the gain control 210, and provides a mixed output to the audio amplifier 128 to be provided to the vehicle speakers 130 for conversion from an electronic signal into an acoustical wave. Suppression control logic 216 receives various status signals 218, and provides a cross-fader control signal 220 to control the operation of the cross-fader 208 and a gain "duck" control signal 222 to control the operation of the gain control 210. In an example, the suppression control logic 216 may fade from the media audio signal with vocals 202 to the media audio signal without vocals 206 responsive to the status signals 218 indicating that a navigation prompt is to be provided by the platform audio 212 to the user. It should be noted that the illustrated block diagram 200 is merely an example, and more, fewer, and/or differently located elements may be used.

The media audio signal with vocals 202 may include the audio of whatever media content is currently selected to be experienced by occupants of the vehicle 102. In an example, the specific media content, as well as the volume of the audio of the media content, may have been selected by one of the occupants of the vehicle.

The vocal suppressor 204 may be configured to apply one or more audio processing algorithms to the media audio signal with vocals 202 to remove the vocal energy. In one example, the vocal suppressor 204 may take advantage of the fact that in many stereo tracks the vocal information is centered. Accordingly, the vocal suppressor 204 may invert one of the two stereo tracks and then merge the results back together, such that the centered vocal content is canceled out and removed. In another example, the vocal suppressor 204 may additionally or alternately use equalization techniques to remove frequencies in which voice energy typically occurs. In yet a further example, the vocal suppressor 204 may utilize principal component analysis to distinguish relatively low-variation musical instrument signals from relatively high-variation vocal signals, and then remove the high-variation vocal signals. Regardless of approach or combination of approaches that are used, the vocal suppressor 204 may provide the media audio signal without vocals 206 based on the processing of the media audio signal with vocals 202.

The cross-fader 208 allows one source to fade in while another source fades out. As shown, the cross-fader 208 may be configured to combine the media audio signal with vocals 202 and the media audio signal without vocals 206 in relative quantities specified by the cross-fader control signal 220 received by the cross-fader 208 from the suppression control logic 216.

Ducking is an audio effect in which a level of one audio signal is reduced responsive to the presence of another signal. The gain control 210 may be configured to provide ducking functionality by allowing its output signal to be provided as a controllably scaled version of its input signal. As shown, the gain control 210 may be configured to receive the output signal of the cross-fader 208, and duck the volume of the received signal based on a value of the gain "duck" control signal 222 provided to the gain control 210 from the suppression control logic 216.

The adder 214 allows for the mixing in of the level-adjusted output from the gain control 210 with the platform audio signal 212 received from the audio output 120 of the computing platform 104. Thus, the adder 214 is configured to allow for additional content from the computing platform 104 (such as navigation commands or other prompts) to be overlaid on the media audio.

The suppression control logic 216 may be configured to receive the various status signals 218, and provide a cross-fader control signal 220 to control the operation of the cross-fader 208 and a gain "duck" control signal 222 to control the operation of the gain control 210.

The status signals 218 may include, as some examples: a vehicle warning signal that is set by one or more ECUs 148 of the vehicle 102 to indicate a collision, backup, or other warning identified by the vehicle 102; a ring or call active signal that is set by the computing platform 104 to indicate an incoming, outgoing, or established call; an in-cabin conversation signal that is set by the computing platform 104, e.g., by detection of vocals being received by the microphone 116 to indicate an ongoing conversation between vehicle 102 occupants; or a platform prompt signal that is set by the computing platform 104 when the computing platform 104 is to provide or is providing a prompt via the audio output 120.

The suppression control logic 216 may utilize the received status signals 218 to identify whether trigger conditions have occurred to transition the audio processor 124 from a first mode in which the media audio signal with vocals 202 is provided to a second mode in which the media audio signal without vocals 206 is provided. For instance, if a vehicle warning, telephone call, in-cabin conversation, or computing platform 104 prompt is occurring or to occur, the suppression control logic 216 may indicate that a trigger condition has been met.

Similarly, the suppression control logic 216 may utilize the received status signals 218 to identify whether trigger conditions are no longer occurring to transition the audio processor 124 from the second mode in which the media audio signal without vocals 206 is provided back to the first mode in which the media audio signal with vocals 202 is provided. For instance, if the vehicle warning, telephone call, in-cabin conversation, or computing platform 104 prompt is no longer occurring, the suppression control logic 216 may indicate that the trigger condition is no longer being met.

Responsive to the trigger condition being met, the suppression control logic 216 may adjust the cross-fader control signal 220. In an example, when in the first mode, the cross-fader control signal 220 may be set by the suppression control logic 216 to a value configured to cause the cross-fader 208 to provide the media audio signal with vocals 202 to the gain control 210. When in the second mode, the cross-fader control signal 220 may be set by the suppression control logic 216 to cause the cross-fader 208 to provide the media audio signal without vocals 206 to the gain control 210.

To provide for smooth transitions between the first and second modes, the suppression control logic 216 may adjust the cross-fader control signal 220 using a predefined slope over a predefined period of time to gradually adjust between the media audio signal with vocals 202 and the media audio signal without vocals 206. In an example, responsive to a trigger condition indicating a transition from the first mode to the second mode, the suppression control logic 216 may provide a cross-fader control signal 220 gradually reducing the level of the media audio signal with vocals 202 and increasing the level of the media audio signal without vocals 206 until the media audio signal without vocals 206 replaces the media audio signal with vocals 202 as the output of the cross-fader 208. In another example, responsive to conclusion of the trigger condition indicating a transition from the second mode to the first mode, the suppression control logic 216 may provide a cross-fader control signal 220 using the predefined slope over the predefined period of time to gradually reducing the level of the media audio signal without vocals 206 and increase the level of the media audio signal with vocals 202 until the media audio signal with vocals 202 replaces the media audio signal without vocals 206 as the output of the cross-fader 208. The pre-determined period of time may be any length of time and may also be immediate if so desired.

Also, responsive to the trigger condition being met, the suppression control logic 216 may adjust the gain "duck" control signal 222. In an example, when in the first mode the gain "duck" control signal 222 may be set to a higher level of gain than in the second mode, as when in the second mode there is additional platform audio signal 212 that may be mixed into the resultant sound output by the adder 214 to be provided to the audio amplifier 128 and then to the vehicle speakers 130. This lowering of the level may be set such that the remaining content is comfortable for the user to engage in conversation with an end user or vehicle system. It may also be applied to aid in the intelligibility of system prompts that are required to be played via the platform audio signal 212, such as a navigation turn command.

Figure 3:
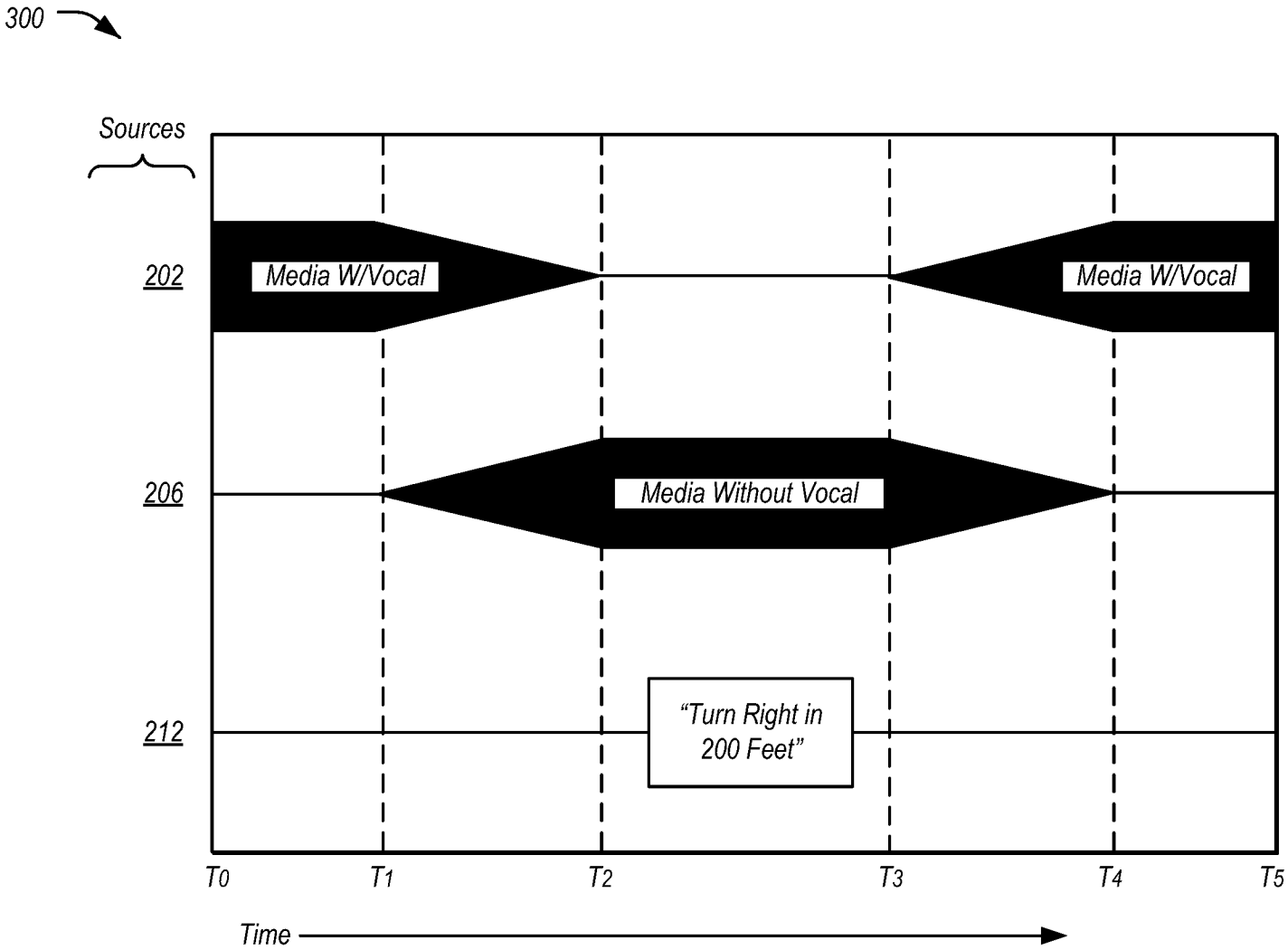
FIG. 3 illustrates an example diagram of a transition between modes to facilitate the providing of platform audio to a user.

FIG. 3 illustrates an example diagram 300 of a transition between modes to facilitate the providing of platform audio signal 212 to a user. More specifically, the diagram 300 illustrates output from sources over time, the sources including the media audio signal with vocals 202, the media audio signal without vocals 206, and the platform audio signal 212.

In the illustrated example, at time $T_0$, the suppression control logic 216 is directing the cross-fader 208 to pass the media audio signal with vocals 202 and not the media audio signal without vocals 206. At time $T_1$, the suppression control logic 216 identifies a trigger condition based on the received status signals 218. In the illustrated example, the trigger condition is that a navigation command is upcoming to be provided to the user. Between $T_1$ and $T_2$, the suppression control logic 216 directs the cross-fader 208 to fade from the media audio signal with vocals 202 to the media audio signal without vocals 206. Additionally, between $T_2$ and $T_3$, the platform audio signal 212 indicates the navigation command to be provided to the user, e.g., "turn right in 200 feet." During the playback of the platform audio signal 212, the suppression control logic 216 may further direct the gain control 210 to perform ducking to reduce the level of the media audio signal without vocals 206 to a lower background level. Overall, this provides both a pleasant user experience and an advantage that the prompt is easier to understand as the distracting vocal is removed. Responsive to completion of the trigger condition, at $T_3$ the suppression control logic 216 identifies that the trigger condition is no longer occurring. According to that determination, between $T_3$ and $T_4$ the suppression control logic 216 directs the cross-fader 208 to fade from the media audio signal without vocals 206 to the media audio signal with vocals 202. The example ends at time $T_5$.

In another example, an alternative or lower cost implementation could also be made by replacing the Crossfader 208 and Gain Control 210 with a simple switch. In this case the Gain "Duck" 222 signal would not be used and the Cross-Fader Control 220 would trigger a hard switch between Media Audio w/o Vocals 206 and Media Audio with Vocals 202.

Figure 4:
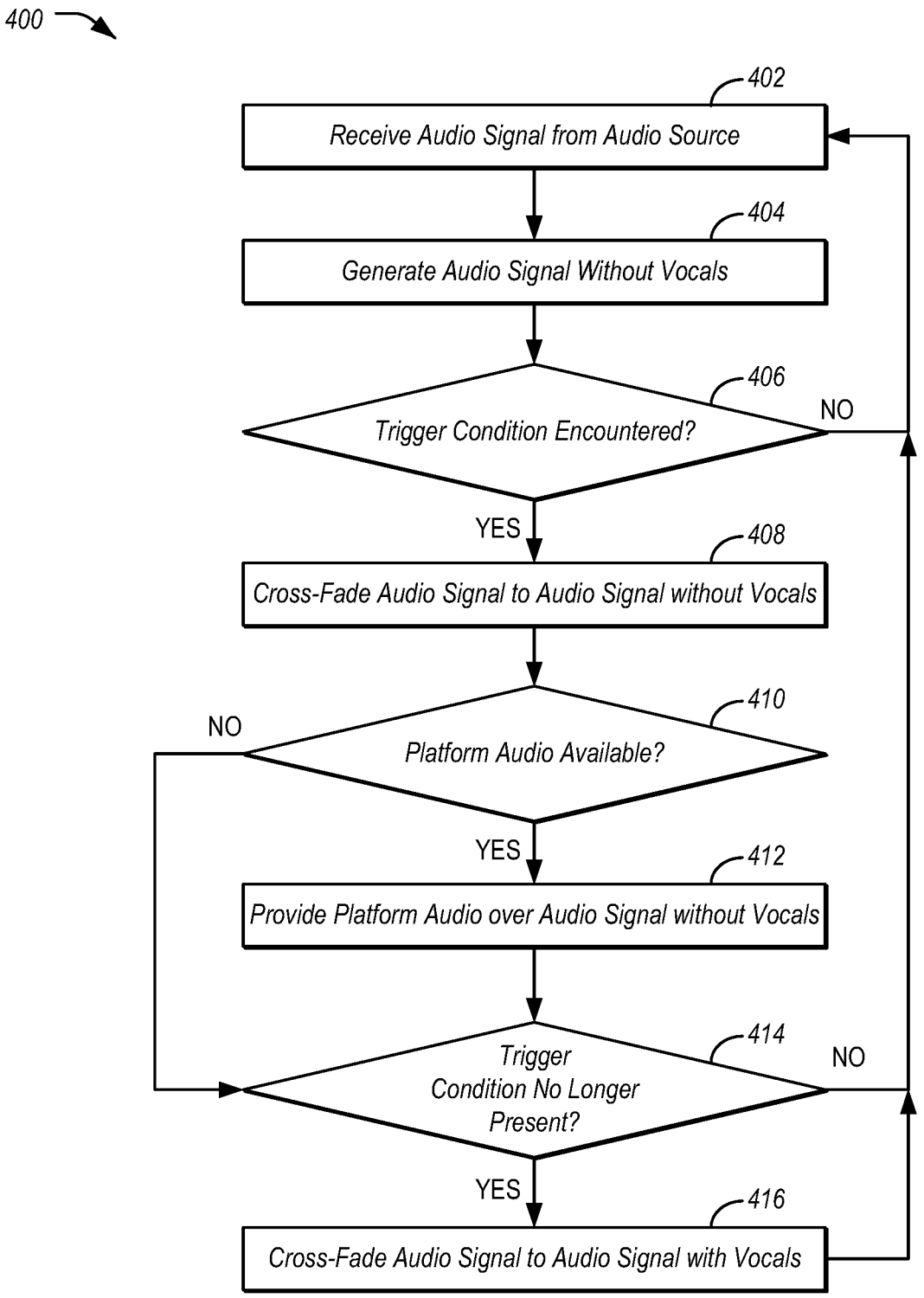
FIG. 4 illustrates an example process for vocal suppression functionality applied to media audio in the vehicle environment to aid in improving user concentration.

FIG. 4 illustrates an example process 400 for vocal suppression functionality applied to media audio in the vehicle environment to aid in improving user concentration. In an example, the process 400 may be performed using the audio processor 124 of the system 100 discussed in detail above with respect to FIGS. 1-3.

At operation 402, the audio processor 124 receives an audio signal from the audio sources 126. In an example, the audio processor 124 may receive media audio signal with vocals 202 from a selected one of the audio sources 126. The media audio signal with vocals 202 may include audio of whatever audio source 126 is currently selected to be experienced by occupants of the vehicle 102.

At 404, the audio processor 124 generates a media audio signal without vocals 206. In an example, the vocal suppressor 204 of the audio processor 124 receives the media audio signal with vocals 202 and transforms the media audio signal with vocals 202 into a media audio signal without vocals 206. The vocal suppressor 204 may use one or more of the vocal suppression techniques discussed in detail above, such as center content cancellation, equalization, or principal component analysis.

The audio processor 124 determines whether a trigger condition is encountered at 406. In an example, the audio processor 124 receives various status signals 218 which, when set, may indicate one or more trigger conditions. For instance, if a vehicle warning, telephone call, in-cabin conversation, or computing platform 104 prompt is occurring or to occur, the suppression control logic 216 of the audio processor 124 may indicate that a trigger condition has been met. If a trigger condition has been met, control passes to operation 408. Otherwise, control returns to operation 402.

At 408, the audio processor 124 cross-fades the audio signal to the media audio signal without vocals 206. In an example, the suppression control logic 216 of the audio processor 124 adjusts the cross-fader control signal 220 to direct the cross-fader 208 to fade from the media audio signal with vocals 202 to the media audio signal without vocals 206.

At operation 410, the audio processor 124 determines whether platform audio signal 212 is available. In an example, the suppression control logic 216 may identify, based on the status signals 218, that platform audio signal 212 is available, e.g., due to the status signals 218 indicating a navigation command is upcoming to be provided in the platform audio signal 212. In another example, the audio processor 124 may determine that the platform audio signal 212 is available simply by monitoring that the platform audio signal 212 includes an audio signal having at least a minimum predefined threshold volume. This monitoring may be performed, in an example, by the suppression control logic 216. If platform audio signal 212 is available, control passes to operation 412. Otherwise, control passes to operation 414.

At 412, the audio processor 124 provides the platform audio signal 212 over the media audio signal without vocals 206. In an example, the adder 214 of the audio processor 124 sums the platform audio signal 212 and the media audio signal without vocals 206, and provides the resultant output to the audio amplifier 128 to be reproduced by the vehicle speakers 130. In another example, the suppression control logic 216 may adjust the gain "duck" control signal 222 to lower the volume of the media audio signal without vocals 206 being summed with the platform audio signal 212. This may be done set such that the resultant combined content is more comfortable for the user.

The audio processor 124 determines whether the trigger condition is no longer present at 414. For instance, if the vehicle warning, telephone call, in-cabin conversation, or computing platform 104 prompt is determined according to the status signals 218 to no longer occur, the suppression control logic 216 of the audio processor 124 may indicate that a trigger condition is no longer met. If the trigger condition is no longer being met, control passes to operation 416. Otherwise, control returns to operation 402.

At operation 416, the audio processor 124 cross-fades the media audio signal without vocals 206 to the audio signal. In an example, the suppression control logic 216 of the audio processor 124 adjusts the cross-fader control signal 220 to direct the cross-fader 208 to fade from the media audio signal without vocals 206 to the media audio signal with vocals 202. After operation 416, control returns to operation 402.

Variations on the disclosed aspects are possible. In an example, the process 400 may also be applied in the case where no platform audio is desired. An example of this may be for detection of a conversation in the vehicle being utilized to generate a trigger condition at operation 406. In this case, the system would play the audio signal without vocals until the trigger condition is removed at operation 414. This could be resultant of vehicle occupants ending their conversation.

Computing devices described herein generally include computer-executable instructions, where the instructions may be executable by one or more computing devices such as those listed above. Computer-executable instructions may be compiled or interpreted from computer programs created using a variety of programming languages and/or technologies, including, without limitation, and either alone or in combination, Java™, C, C++, C#, Visual Basic, Java Script, Perl, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A system comprising:

an audio processor programmed to generate a vocal-free audio signal from an audio signal received from an audio source by removing vocal energy from the audio signal, direct a cross-fader to fade from the audio signal to the vocal-free audio signal responsive to occurrence of a trigger condition indicated by a status signal, the trigger condition indicating that a prompt including vocal content is to be provided, provide the prompt summed to the vocal-free audio signal for playback, and direct the cross-fader to fade from the vocal-free audio signal to the audio signal responsive to the trigger condition no longer being present.

2. The system of claim 1, wherein the audio processor is further programmed to provide platform audio summed to the vocal-free audio signal responsive to the platform audio being identified as available.

3. The system of claim 2, wherein the audio processor is further programmed to lower a volume of the vocal-free audio signal being summed to the platform audio responsive to the platform audio being identified as available.

4. The system of claim 2, wherein the audio processor is further programmed to identify the platform audio as being available responsive to the status signal being set to indicate a navigation application is to provide or is providing the prompt via the platform audio.

5. The system of claim 2, wherein the audio processor is further programmed to identify the platform audio as being available responsive to identifying that the platform audio includes an audio signal having at least a minimum predefined threshold volume.

6. The system of claim 1, wherein the audio processor is further programmed to generate the vocal-free audio signal by using one or more of center content cancellation, equalization, or principal component analysis.

7. The system of claim 1, wherein the audio processor is further programmed to identify the trigger condition per a status signal indicative of a presence of in-vehicle conversation, and identify the trigger condition no longer being present per the status signal being indicative of a lack of presence of in-vehicle conversation.

8. A method comprising:

generating a vocal-free audio signal from an audio signal received from an audio source by removing vocal energy from the audio signal;

directing a cross-fader to fade from the received audio signal to the vocal-free audio signal responsive to occurrence of a trigger condition indicating a prompt is to be provided;

providing the prompt summed to the vocal-free audio signal for playback; and directing the cross-fader to fade from the vocal-free audio signal to the audio signal responsive to the prompt being provided.

9. The method of claim 8, further comprising:

receiving a signal from a computing platform indicating that the prompt is to be provided to cause the occurrence of the trigger condition; and receiving the prompt to be provided as audio output from the computing platform.

10. The method of claim 8, further comprising lowering a volume of the vocal-free audio signal being summed to the prompt responsive to receiving the prompt.

11. The method of claim 8, further comprising generating the vocal-free audio signal by using center content cancellation of the received audio signal.

12. The method of claim 8, further comprising generating the vocal-free audio signal by using equalization of the received audio signal.

13. The method of claim 8, further comprising generating the vocal-free audio signal by using principal component analysis of the received audio signal.

14. A non-transitory computer-readable medium comprising instructions that, when executed by an audio processor, cause the audio processor to:

generate a vocal-free audio signal from an audio signal received from an audio source by removing vocal energy from the audio signal;

direct a cross-fader to fade from the audio signal to the vocal-free audio signal responsive to occurrence of a trigger condition indicated by a status signal, the trigger condition indicating that a prompt including vocal content is to be provided;

provide the prompt summed to the vocal-free audio signal for playback; and direct the cross-fader to fade from the vocal-free audio signal to the audio signal responsive to trigger condition no longer being present.

15. The medium of claim 14, further comprising instructions that, when executed by an audio processor, cause the audio processor to provide platform audio summed to the vocal-free audio signal responsive to the platform audio being identified as available.

16. The medium of claim 15, further comprising instructions that, when executed by an audio processor, cause the audio processor to lower a volume of the vocal-free audio signal being summed to the platform audio responsive to the platform audio being identified as available.

17. The medium of claim 15, further comprising instructions that, when executed by an audio processor, cause the audio processor to identify the platform audio as being available responsive to receipt of a platform prompt signal set when a computing platform of a vehicle is to provide or is providing a prompt via the platform audio.

18. The medium of claim 15, further comprising instructions that, when executed by an audio processor, cause the audio processor to identify the platform audio as being available responsive to identifying that the platform audio includes an audio signal having at least a minimum predefined threshold volume.

19. The medium of claim 14, further comprising instructions that, when executed by an audio processor, cause the audio processor to generate the vocal-free audio signal by using one or more of center content cancellation, equalization, or principal component analysis.

20. The medium of claim 14, further comprising instructions that, when executed by an audio processor, cause the audio processor to identify the trigger condition per a status signal indicative of a presence of in-vehicle conversation, and identify the trigger condition no longer being present per the status signal being indicative of a lack of presence of in-vehicle conversation.

* * * * *